US010222141B2

(12) United States Patent
Higashiiue et al.

(10) Patent No.: US 10,222,141 B2
(45) Date of Patent: Mar. 5, 2019

(54) STACKING TYPE HEADER, HEAT EXCHANGER AND AIR-CONDITIONING APPARATUS

(71) Applicant: Mitsubishi Electric Corporation, Tokyo (JP)

(72) Inventors: Shinya Higashiiue, Tokyo (JP); Shigeyoshi Matsui, Tokyo (JP); Takashi Okazaki, Tokyo (JP); Akira Ishibashi, Tokyo (JP); Daisuke Ito, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 190 days.

(21) Appl. No.: 14/915,276

(22) PCT Filed: Oct. 1, 2013

(86) PCT No.: PCT/JP2013/076736

§ 371 (c)(1),
(2) Date: Feb. 29, 2016

(87) PCT Pub. No.: WO2015/049727

PCT Pub. Date: Apr. 9, 2015

(65) Prior Publication Data

US 2016/0202000 A1 Jul. 14, 2016

(51) Int. Cl.
*F28F 9/02* (2006.01)
*F28F 3/08* (2006.01)
(Continued)

(52) U.S. Cl.
CPC ..... *F28F 9/0265* (2013.01); *F28F 3/086* (2013.01); *F28F 9/0221* (2013.01);
(Continued)

(58) Field of Classification Search
CPC ..... F28F 9/02; F28F 9/0221; F28F 9/0278; F25B 39/028
See application file for complete search history.

(56) References Cited

U.S. PATENT DOCUMENTS 4,911,236 A 3/1990 Laveran
5,241,839 A * 9/1993 Hughes ..... B60H 1/3227 165/174
(Continued)

FOREIGN PATENT DOCUMENTS

JP H08-061809 A 3/1996
JP H09-189463 A 7/1997
(Continued)

OTHER PUBLICATIONS

Extended European Search Report dated Jun. 14, 2017 issued in corresponding EP patent application No. 13895063.9.
(Continued)

*Primary Examiner* — Eric Ruppert
(74) *Attorney, Agent, or Firm* — Posz Law Group, PLC

(57) ABSTRACT

A stacking type header according to the present invention includes a first plate shaped body having a plurality of first outlet flow paths and a second plate shaped body stacked on the first plate shaped body and having a distribution flow path so that refrigerant flowing from a first inlet flow path is distributed and flows out to the plurality of first outlet flow paths. A branch flow path of the distribution flow path is formed to allow refrigerant flowing into a branch section to flow out in an upwardly declined or downwardly declined direction.

11 Claims, 7 Drawing Sheets

(51) Int. Cl.

| | |
|---|---|
| *F25B 39/02* | (2006.01) |
| *F28D 1/053* | (2006.01) |
| *F28F 1/32* | (2006.01) |

(52) U.S. Cl.
CPC ..... *F28F 9/0275* (2013.01); *F28F 9/0278* (2013.01); *F25B 39/028* (2013.01); *F28D 1/05366* (2013.01); *F28F 1/32* (2013.01)

(56) References Cited

U.S. PATENT DOCUMENTS

| | | | | |
|---|---|---|---|---|
| 5,242,016 | A * | 9/1993 | Voss | F25B 39/028 165/173 |
| 6,250,379 | B1 * | 6/2001 | Geissler | A23C 3/033 165/145 |
| 6,616,327 | B1 * | 9/2003 | Kearney | B01F 5/06 366/340 |

FOREIGN PATENT DOCUMENTS

| | | | |
|---|---|---|---|
| JP | H09-273829 | A | 10/1997 |
| JP | H10-267468 | A | 10/1998 |
| JP | H11-118295 | A | 4/1999 |
| JP | 2000-161818 | A | 6/2000 |
| JP | 3444750 | B2 | 6/2003 |

OTHER PUBLICATIONS

Office Action dated Aug. 23, 2016 for the corresponding JP application No. 2015-540291 (and English translation).
International Search Report of the International Searching Authority dated Jan. 7, 2014 for the corresponding international application No. PCT/JP2013/076736 (and English translation).
Office Action dated Mar. 16, 2017 issued in corresponding CN patent application No. 201380079986.X (and English translation).
Office Action dated Nov. 29, 2017 issued in corresponding CN patent application No. 201380079986.X (and English translation attached).

* cited by examiner

STACKING TYPE HEADER, HEAT EXCHANGER AND AIR-CONDITIONING APPARATUS

CROSS REFERENCE TO RELATED APPLICATION

This application is a U.S. national stage application of International Application No. PCT/JP2013/076736 filed on Oct. 1, 2013, the disclosure of which is incorporated herein by reference.

TECHNICAL FIELD

The present invention relates to stacking type headers, heat exchangers and air-conditioning apparatuses.

BACKGROUND ART

Conventional stacking type headers include a first plate shaped body having a plurality of outlet flow paths and a second plate shaped body stacked on the first plate shaped body and having a distribution flow path so that refrigerant flowing from the inlet flow path is distributed and flows out of the plurality of outlet flow paths of the first plate shaped body. The distribution flow path includes a branch flow path having a plurality of recesses that extend radially in a direction perpendicular to a flow direction of refrigerant. The refrigerant that flows from the inlet flow path into the branch flow path is branched into a plurality of portions while passing through the plurality of recesses, and flows out through the plurality of outlet flow paths of the first plate shaped body (for example, Patent Literature 1).

CITATION LIST

Patent Literature

Patent Literature 1: Japanese Unexamined Patent Application Publication No. 2000-161818 (paragraphs [0012] to [0020], FIG. 1, and FIG. 2)

SUMMARY OF INVENTION

Technical Problem

When this type of stacking type header is used if a flow direction of refrigerant that flows into the branch flow path is not parallel to the gravity direction, refrigerant is subject to the effect of the gravity, leading to shortage or excess of refrigerant in any of the branch directions. That is, the conventional stacking type headers have a problem in that uniformity of refrigerant distribution is insufficient.

The present invention has been made to overcome the above problem, and an object of the present invention is to provide a stacking type header having an improved uniformity of refrigerant distribution. Another object of the present invention is to provide a heat exchanger having the same stacking type header. Still another object of the present invention is to provide an air-conditioning apparatus having the same heat exchanger.

Solution to Problem

A stacking type header according to the present invention includes a first plate shaped body having a plurality of first outlet flow paths; and a second plate shaped body stacked on the first plate shaped body and having a distribution flow path so that refrigerant flowing from a first inlet flow path is distributed and flows out to the plurality of first outlet flow paths. The distribution flow path includes at least one branch flow path having a branch section, an inflow flow path communicating with the branch section, and a plurality of outflow flow paths communicating with the branch section. The inflow flow path includes a portion unparallel to a gravity direction to allow the refrigerant to flow into the branch section via the portion. At least one outflow flow path of the plurality of outflow flow paths allows the refrigerant to flow out in a second direction upwardly or downwardly inclined at an end communicating with the branch section, the second direction being defined by inclining a first direction having a start point located at the center of the branch section and an end point located at the same level as the center in the gravity direction so that the end point is brought toward a second plane parallel to a first plane that is perpendicular to the portion unparallel to the gravity direction and extending through the center of the branch section.

Advantageous Effects of Invention

In the stacking type header according to the present invention, at least one outflow flow path of the plurality of outflow flow paths is configured to allow the refrigerant to flow out in the second direction upwardly or downwardly inclined at an end that does not communicate with the branch section, the second direction being defined by inclining the first direction having the start point located at the center of the branch section and the end point located at the same level as the center in the gravity direction so that the end point is brought toward the second plane parallel to the first plane that is perpendicular to the portion unparallel to the gravity direction and extending through the center of the branch section. Therefore, compared with the case in which the plurality of outflow flow paths are configured to allow the refrigerant to flow in a first direction having a start point located at the center of the branch section and an end point located at the same level as the center in the gravity direction, the effect of inertia force generated when refrigerant passes through the inflow flow path can be reduced, thereby improving uniformity of distribution of refrigerant that flows out of the plurality of first outlet flow paths of the stacking type header.

DESCRIPTION OF EMBODIMENTS

With reference to the drawings, a stacking type header according to the present invention will be described below.

Although the stacking type header according to the present invention distributes refrigerant flowing into a heat exchanger in the following description, the stacking type header according to the present invention may distribute refrigerant flowing into another device. Further, the configuration and the operation described below are merely an example, and the stacking type header according to the present invention is not limited to such configuration and operation. Throughout the drawings, the same or similar elements are denoted by the same reference signs or shown without reference signs. Further, the detailed configurations are simplified or omitted as appropriate. Further, duplicated or similar description is simplified or omitted as appropriate.

Embodiment 1

A heat exchanger according to Embodiment 1 will be described.

<Configuration of Heat Exchanger>

A configuration of the heat exchanger according to Embodiment 1 will be described below.

Figure 1:
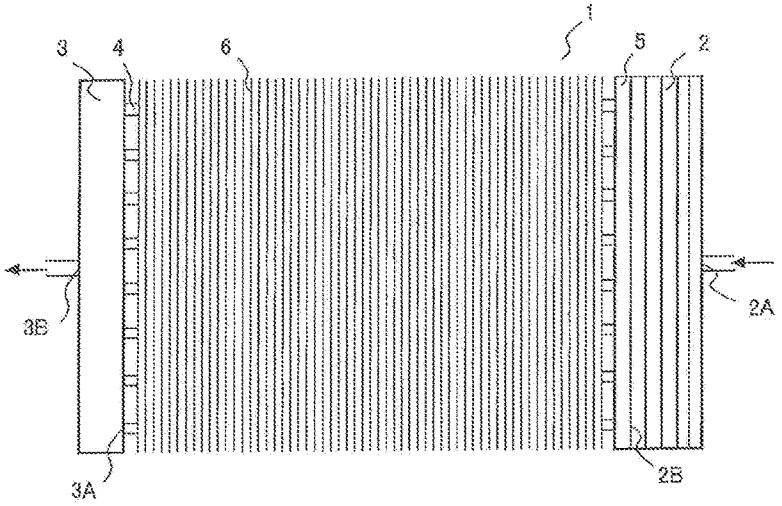
FIG. 1 is a view showing a configuration of a heat exchanger according to Embodiment 1.

FIG. 1 is a view showing the configuration of the heat exchanger according to Embodiment 1.

As shown in FIG. 1, a heat exchanger 1 includes a stacking type header 2, a header 3, a plurality of first heat-transfer tubes 4, a holding member 5 and a plurality of fins 6.

The stacking type header 2 includes a refrigerant inlet 2A and a plurality of refrigerant outlets 2B. The header 3 includes a plurality of refrigerant inlets 3A and a refrigerant outlet 3B. The refrigerant inlet 2A of the stacking type header 2 and the refrigerant outlet 3B of the header 3 are connected to a refrigerant pipe. The refrigerant outlets 2B of the stacking type header 2 and the refrigerant inlets 3A of the header 3 are connected by the first heat-transfer tubes 4.

The first heat-transfer tube 4 may be a flat tube having a plurality of flow paths or a circular tube having a small diameter (for example, a diameter of 4 mm or less). The first heat-transfer tube 4 is made of, for example, aluminum. An end of the first heat-transfer tube 4 facing the stacking type header 2 is connected to the refrigerant outlet 2B of the stacking type header 2 while being held by the plate shaped holding member 5. The holding member 5 is made of, for example, aluminum or aluminum alloy. The first heat-transfer tubes 4 are joined to the plurality of fins 6 by brazing or another related method. The fin 6 is made of, for example, aluminum. Although FIG. 1 shows that eight first heat-transfer tubes 4 are provided, the invention is not limited thereto. For example, two first heat-transfer tubes 4 may be provided.

<Flow of Refrigerant in Heat Exchanger>

The flow of refrigerant in the heat exchanger according to Embodiment 1 will be described below.

Refrigerant flowing in the refrigerant pipe flows into the stacking type header 2 for distribution via the refrigerant inlet 2A, and flows into the plurality of first heat-transfer tubes 4 via the plurality of refrigerant outlets 2B. Refrigerant in the plurality of first heat-transfer tubes 4 exchanges heat with air or another medium supplied by, for example, a fan. After flowing in the plurality of first heat-transfer tubes 4, refrigerant flows into the header 3 for merging via the plurality of refrigerant inlets 3A, and flows into the refrigerant pipe via the refrigerant outlet 3B. Refrigerant can flow in the reverse direction.

<Configuration of Stacking Type Header>

A configuration of the stacking type header of the heat exchanger according to Embodiment 1 will be described below.

Figure 2:
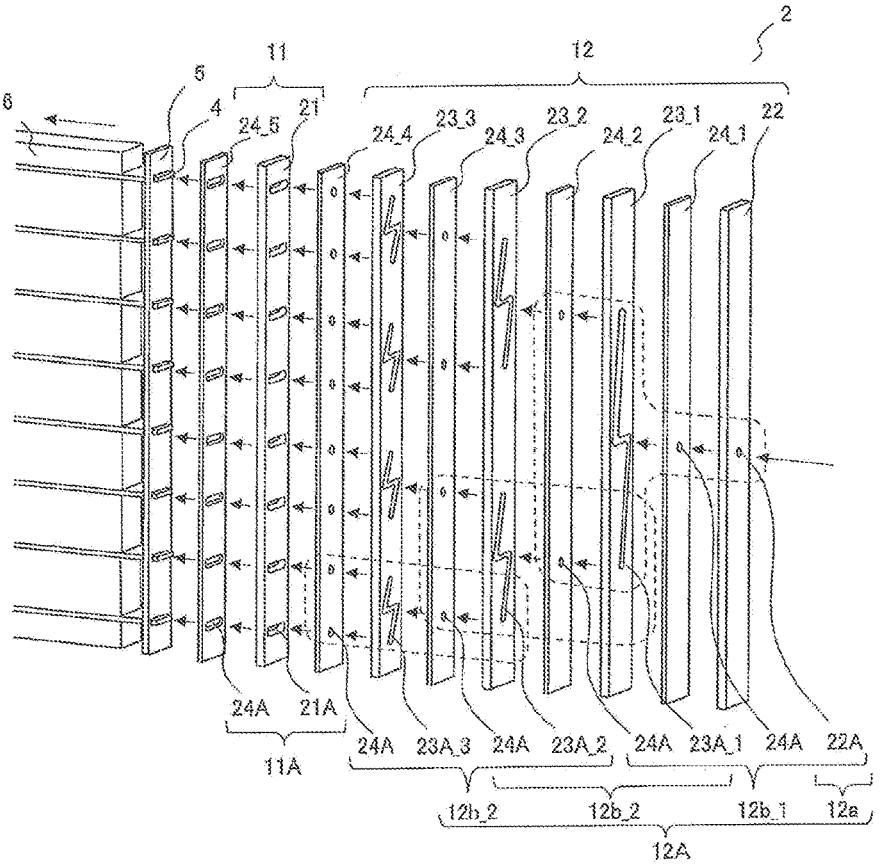
FIG. 2 is a perspective view of the heat exchanger according to Embodiment 1 showing a stacking type header in an exploded state.

FIG. 2 is a perspective view of the heat exchanger according to Embodiment 1 showing a stacking type header in an exploded state.

As shown in FIG. 2, the stacking type header 2 includes first plate shaped bodies 11 and second plate shaped bodies 12. The first plate shaped bodies 11 are stacked on the outflow side of refrigerant. The second plate shaped bodies 12 are stacked on the inflow side of the refrigerant.

The first plate shaped body 11 includes a first plate shaped member 21 and a clad material 24_5. The second plate shaped body 12 includes a second plate shaped member 22, a plurality of third plate shaped members 23_1 to 23_3, and a plurality of clad materials 24_1 to 24_4. One or both surfaces of the clad materials 24_1 to 24_5 are coated with brazing material. The first plate shaped member 21 is stacked on the holding member 5 and the clad material 24_5 is interposed therebetween. The plurality of third plate shaped members 23_1 to 23_3 are stacked on the first plate shaped member 21 and the clad materials 24_2 to 24_4 are each interposed therebetween. The second plate shaped member 22 is stacked on the third plate shaped member 23_1 and the clad material 24_1 is interposed therebetween. The first plate shaped member 21, the second plate shaped member 22, and the third plate shaped members 23_1 to 23_3 have a thickness of about 1 to 10 mm, and is made of, for example, aluminum or aluminum alloy. The clad materials 24_1 to 24_5 are made of, for example, aluminum or aluminum alloy. Hereinafter, the holding member 5, the first plate shaped member 21, the second plate shaped member 22, the third plate shaped members 23_1 to 23_3, and the dad materials 24_1 to 24_5 are also collectively referred to as a plate shaped member. Further, the third plate shaped members 23_1 to 23_3 are also collectively referred to as a third plate shaped member 23. Further, the clad materials 24_1 to 24_5 are also collectively referred to as a clad material 24.

The holding member 5, the first plate shaped member 21, the second plate shaped member 22, and the third plate shaped members 23_1 to 23_3 may be directly stacked without the clad material 24 interposed. Each of the holding member 5, the first plate shaped member 21, the second plate shaped member 22, the third plate shaped members 23_1 to 23_3 may be integrally formed with each adjacent clad material 24 to form plate shaped members, which may be directly stacked on each other.

A plurality of first outlet flow paths 11A are made up of flow paths 21A formed in the first plate shaped member 21 and flow paths 24A formed in the clad material 24_5. The flow path 21A and the flow path 24A are through holes having an inner peripheral surface extending along an outer peripheral surface of the first heat-transfer tube 4. The end of the first heat-transfer tube 4 is held by the holding member 5 by brazing. When the first plate shaped body 11 and the holding member 5 are joined, the end of the first heat-transfer tube 4 and the first outlet flow path 11A are connected. The first outlet flow path 11A and the first heat-transfer tube 4 may be joined without using the holding member 5, reducing the cost of components. The plurality of first outlet flow paths 11A correspond to the plurality of refrigerant outlets 2B in FIG. 1.

A distribution flow path 12A is made up of flow paths 22A formed in the second plate shaped member 22, flow paths 23A_1 to 23A_3 formed in the third plate shaped members 23_1 to 23_3, and flow paths 24A formed in the clad materials 24_1 to 24_4. The distribution flow path 12A includes a first inlet flow path 12*a*, a branch flow path 12*b*_1, and a plurality of branch flow paths 12*b*_2. Hereinafter, the flow paths 23A_1 to 23A_3 are also collectively referred to as a flow path 23A. Further, the branch flow path 12*b*_1 and the plurality of branch flow paths 12*b*_2 are also collectively referred to as a branch flow path 12*b*.

The first inlet flow path 12*a* is made up of the flow path 22A formed in the second plate shaped member 22. The flow path 22A is a circular through hole. The refrigerant pipe is connected to the first inlet flow path 12*a*. The first inlet flow path 12*a* corresponds to the refrigerant inlet 2A in FIG. 1.

The branch flow path 12*b*_1 is made up of the flow path 22A formed in the second plate shaped member 22, the flow path 24A formed in the clad material 24_1, the flow path 23A formed in the third plate shaped member 23_1, and the flow path 24A formed in the clad material 24_2.

The branch flow path 12*b*_2 is made up of a part of the flow path 23A formed in the third plate shaped member 23, the flow path 24A formed in the clad material 24 stacked on the surface of the third plate shaped member 23 at a side from which refrigerant flows out, the flow path 23A formed in the third plate shaped member 23 stacked on the surface of the clad material 24 at a side from which refrigerant flows out, and the flow path 24A formed in the clad material 24 stacked on the surface of the third plate shaped member 23 at a side from which refrigerant flows out. The branch flow path 12*b*_2 is connected to the branch flow path 12*b*_1, and branches the refrigerant branched by the branch flow path 12*b*_1. Hereinafter, the flow path 23A formed in the third plate shaped member 23 in the branch flow path 12*b*_2 is referred to as a flow path 23X, the flow path 24A formed in the clad material 24 stacked on the surface of the third plate shaped member 23 at the side from which refrigerant flows out is referred to as a flow path 24X, the flow path 23A formed in the third plate shaped member 23 stacked on the surface of the clad material 24 at the side from which refrigerant flows out is referred to as a flow path 23Y, and the flow path 24A formed in the clad material 24 stacked on the surface of the third plate shaped member 23 at the side from which refrigerant flows out is referred to as a flow path 24Y. The details of the branch flow path 12*b*_2 will be described later. The branch flow path 12*b*_2 corresponds to "at least one branch flow path" of the present invention.

The flow path 23A is a linear shaped through groove. The flow path 24A connected to the flow path 23A is a circular through hole. Because the flow path 22A and the flow path 23A_1 are connected via the flow path 24A, the flow paths 23A are connected via the flow path 24A, and the flow path 23A_3 and the flow path 21A are connected via the flow path 24A, the refrigerant that passes through the branch flow path 12*b* or the refrigerant flows out of the branch flow path 12*b* is reliably branched by virtue of the flow path 24A that serves as a refrigerant separating flow path.

A part of the area between the ends of the flow path 23A formed in the third plate shaped member 23 and the flow path 24A formed in the clad material 24 stacked on the surface of the third plate shaped member 23 at a side from which refrigerant flows in are disposed at opposed positions. Thus, parts other than the part of the area between the ends of the flow path 23A formed on the third plate shaped member 23 is closed by the clad material 24 stacked on the surface of the third plate shaped member 23 at the side from which refrigerant flows in. Further, the ends of the flow path 23A formed in the third plate shaped member 23 and the flow paths 24A formed in the clad material 24 stacked on the surface of the third plate shaped member 23 at a side from which refrigerant flows out are disposed at opposed positions. Thus, parts other than the ends of the flow path 23A formed in the third plate shaped member 23 is closed by the clad material 24 stacked on the surface of the third plate shaped member 23 at the side from which refrigerant flows out.

Further, a plurality of distribution flow paths 12A may be formed in the second plate shaped body 12 so that the respective distribution flow paths 12A may be connected to parts of the plurality of first outlet flow paths 11A formed in the first plate shaped body 11. Alternatively, the first inlet flow path 12*a* may be formed in a plate shaped member other than the second plate shaped member 22. That is, in the present invention, the first inlet flow path 12*a* includes those formed in the first plate shaped body 11, and in the "distribution flow path" of the present invention, the first inlet flow path 12*a* includes parts other than the distribution flow path 12A formed in the second plate shaped body 12.

<Flow of Refrigerant in Stacking Type Header>

The flow of refrigerant in the stacking type header of the heat exchanger according to Embodiment 1 will be described below.

Refrigerant flows through the first inlet flow path 12*a* into the branch flow path 12*b*_1. After flowing into the branch flow path 12*b*_1, refrigerant flows into a part of an area between the ends of the flow path 23A_1 via the flow path 24A, and then abuts on the surface of the clad material 24_2 and is branched into two portions, each of which flows into the branch flow path 12*b*_2.

In the branch flow path 12*b*_2, the refrigerant passes through a part of the flow path 23X and reaches an end of the flow path 23X, and then flows into a part of an area between the ends of the flow path 23Y via the flow path 24X. After flowing into the part of the area between the ends of the flow path 23Y, the refrigerant abuts on the surface of the clad material 24 in which the flow path 24Y is formed and is branched into two portions, each of which flows into the subsequent branch flow path 12*b*_2. After the sequence is repeated for a plurality of times, the refrigerant flows into the plurality of first outlet flow paths 11A and then into the plurality of first heat-transfer tubes 4.

<Details of Branch Flow Path>

The detail of the branch flow path of the stacking type header of the heat exchanger according to Embodiment 1 will be described below.

Figure 3:
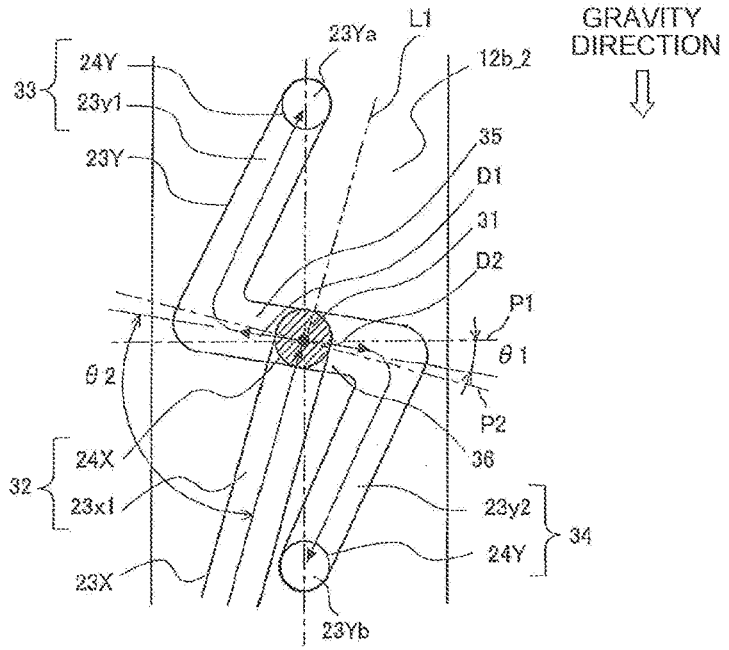
FIG. 3 is a view of overlapped front views of the respective flow paths of the branch flow path of the heat exchanger according to Embodiment 1.

FIG. 3 is a view of overlapped front views of the respective flow paths of the branch flow path of the heat exchanger according to Embodiment 1. In FIG. 3, the branch flow path 12*b*_2 is configured so that a partial flow path 23*x*1 of the flow path 23X is connected to the flow path 24X from the lower side in the gravity direction. However, there also may be the branch flow path 12*b*_2 configured so that a partial flow path 23*x*1 of the flow path 23X is connected to the flow path 24X from the upper side in the gravity direction.

As shown in FIG. 3, the branch flow path 12*b*_2 includes a branch section 31 (hatched area in the drawing), which is a portion of the flow path 23Y that faces the flow path 24X, an inflow flow path 32 communicating with the branch section 31 and is made up of the partial flow path 23*x*1 of the flow path 23X communicating with the flow path 24X and the flow path 24X, a first outflow flow path 33 communicating with the branch section 31 and is made up of the partial flow path 23*y*1 of the flow path 23Y communicating with the flow path 24Y located on the upper side in the gravity direction and the flow path 24Y, and a second outflow flow path 34 communicating with the branch section 31 and is made up of the partial flow path 23*y*2 of the flow path 23Y communicating with the flow path 24Y located on the lower side in the gravity direction and the flow path 24Y.

The inflow flow path 32 allows refrigerant to pass through the partial flow path 23*x*1 and then through the flow path 24X so that refrigerant flows into the branch section 31. The partial flow path 23*x*1 is not parallel to the gravity direction.

The first outflow flow path 33 allows refrigerant to pass through the partial flow path 23*y*1 and then through the flow path 24Y so that refrigerant branched by the branch section 31 flows out. The second outflow flow path 34 allows refrigerant to pass through the partial flow path 23*y*2 and then through the flow path 24Y so that refrigerant branched by the branch section 31 flows out. The partial flow path 23*y*1 and the partial flow path 23*y*2 each have a corresponding one of linear sections 35 and 36 that are in a linear shape and communicate with the branch section 31. Because each of the linear sections 35 and 36 allows a distance to be provided between the branch section 31 and curved sections formed downstream of each of the linear sections 35 and 36, uniformity of refrigerant distribution can be improved.

An upper end 23Ya of the flow path 23Y is located on the upper side in the gravity direction relative to the branch section 31 and the lower end 23Yb is located on the lower side in the gravity direction relative to the branch section 31 so that the refrigerant that flows into the branch section 31 is branched and flow out at different levels. Because the straight line extending between the upper end 23Ya and the lower end 23Yb is parallel to the longitudinal direction of the third plate shaped member 23, the length of the third plate shaped member 23 in the transverse direction can be decreased, thereby reducing the cost for parts, the weight and other related factors. Moreover, because the straight line extending between the upper end 23Ya and the lower end 23Yb is parallel to the arrangement direction of the first heat-transfer tubes 4, the space for the heat exchanger 1 can be reduced. The straight line extending between the upper end 23Ya and the lower end 23Yb, the longitudinal direction of the third plate shaped member 23, and the arrangement direction of the first heat-transfer tubes 4 may not be parallel to the gravity direction.

The linear section 35 and the linear section 36 are perpendicular to the gravity direction, and are inclined by an angle θ1 to a plane P1 that extends through the center of the branch section 31. That is, when a plane that is parallel to a plane perpendicular to the partial flow path 23*x*1 and extends through the center of the branch section 31 is defined as a plane P2, the first outflow flow path 33 allows refrigerant to linearly flow out of the branch section 31 in an upwardly inclined direction D1 that is a direction defined by inclining a line having a start point located at the center of the branch section 31 and an end point located at the same level as the center in the gravity direction by the inclination angle θ1 so that the end point is brought toward the plane P2. The second outflow flow path 34 allows refrigerant to linearly flow out of the branch section 31 in a downwardly inclined direction D2 that is a direction defined by inclining a line having a start point located at the center of the branch section 31 and an end point located at the same level as the center in the gravity direction by the inclination angle θ1 so that the end point is brought toward the plane P2. The direction D1 and the direction D2 are oriented opposite to each other. The plane P2 corresponds to the "second plane" in the present invention. The direction D1 and the direction D2 correspond to the "second direction" in the present invention.

Because the linear section 35 and the linear section 36 are inclined linear sections having the angle θ1 relative to the plane P1, uniformity of refrigerant distribution is improved compared to the configuration in which the linear section 35 and the linear section 36 are linear sections parallel to the plane P1.

Figure 4:
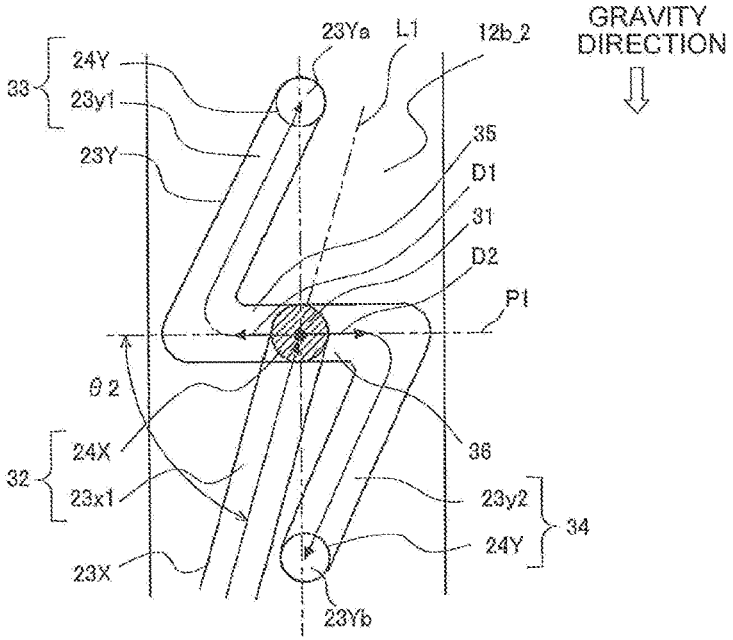
FIG. 4 is a view of overlapped front views of the respective flow paths of the branch flow path of the heat exchanger according to Comparison example.

FIG. 4 is a view of overlapped front views of the respective flow paths of the branch flow path of the heat exchanger according to Comparison example.

That is, when the linear section 35 and the linear section 36 are linear sections parallel to the plane P1, refrigerant flowing into the branch section 31 is more likely to flow into the second outflow flow path 34 due to the inertia force generated when refrigerant passes through the partial flow path 23*x*1. In particular, when refrigerant is in a gas-liquid two-phase state, the inertia force acts on liquid refrigerant that has a density approximately 30 times larger than that of gas refrigerant. Thus, the refrigerant flowing into the branch section 31 is much more likely to flow into the second outflow flow path 34.

On the other hand, when the linear section 35 and the linear section 36 are inclined linear sections having the angle θ1 relative to the plane P1, the difference between the angle of the linear section 35 relative to the partial flow path 23*x*1 and the angle of the linear section 36 relative to the partial flow path 23*x*1 are small. Thus, decrease in uniformity of refrigerant distribution due to the inertia force can be prevented.

The inclination angle θ1 and the inclination angle θ2 are described below in detail. The inclination angle θ2 is an angle formed between the linear sections 35 and 36 and the straight line L1, which is parallel to the partial flow path 23*x*1 and extends through the center of the branch section 31.

If the inclination angle θ1 is an excessively large value, the flow rate of the refrigerant that passes through the second outflow flow path 34 excessively increases due to the effect of the gravity. Therefore, the inclination angle θ1 should be 40 degrees or less.

Figure 5:
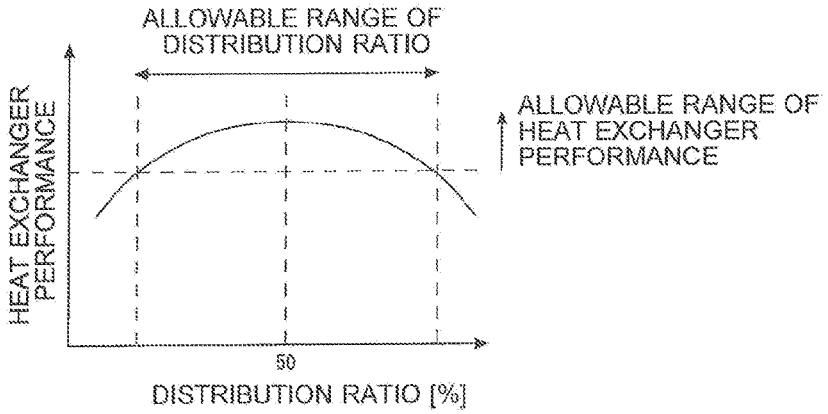
FIG. 5 is a diagram showing a relationship between a distribution ratio and a heat exchanger performance in the heat exchanger according to Embodiment 1.

FIG. 5 is a diagram showing a relationship between a distribution ratio and a heat exchanger performance of the heat exchanger according to Embodiment 1. The distribution ratio is a ratio of the flow rate of refrigerant flowing out of the first outflow flow path 33 to the total amount of the flow rate of refrigerant flowing out of the first outflow flow path 33 and the flow rate of refrigerant flowing out of the second outflow flow path 34. As the distribution ratio approaches 50%, the uniformity of refrigerant distribution is high.

Further, as shown in FIG. 5, as the distribution ratio approaches 50%, the heat exchanger performance improves and the operation efficiency of a refrigeration cycle is high. On the other hand, as the distribution ratio is away from 50%, the heat exchanger performance decreases and the operation efficiency of the refrigeration cycle is low. Thus, the distribution ratio should be in the range that can achieve the allowable range of heat exchanger performance.

Then, taking into consideration the case where the driving frequency of a compressor is controlled by an inverter, the distribution ratio should be in the range that can achieve the allowable range of heat exchanger performance regardless of whether the refrigeration cycle operates under a low flow rate condition or a high flow rate condition.

Figure 6:
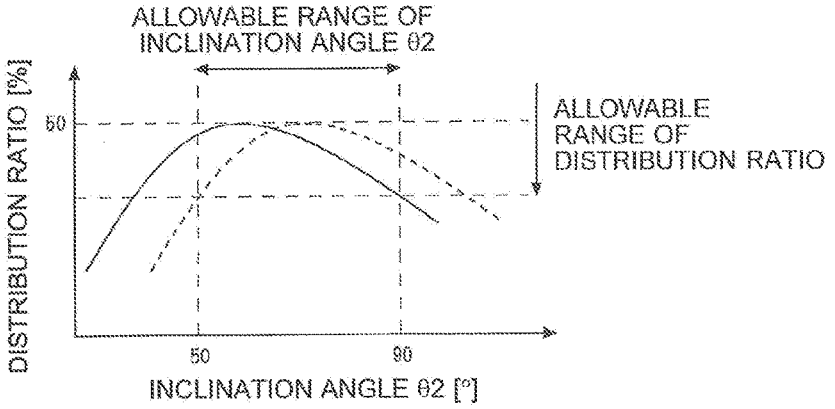
FIG. 6 is diagram showing a representative example of the relationship between an inclination angle θ2 and the distribution ratio under the condition that an inclination angle θ1 is 40 degrees or less in the heat exchanger according to Embodiment 1.

FIG. 6 is diagram showing a representative example of the relationship between the inclination angle θ2 and the distribution ratio under the condition that the inclination angle θ1 is 40 degrees or less in the heat exchanger according to Embodiment 1. In FIG. 6, the solid line represents the relationship when the refrigeration cycle operates under a low flow rate condition, while the dotted line represents the relationship when the refrigeration cycle operates under a high flow rate condition.

Under the condition that the inclination angle θ1 is 40 degrees or less, the distribution ratio becomes closest to 50% when the inclination angle θ2 is a specific angle as shown in FIG. 6. The specific angle varies depending on the flow rate condition of the refrigeration cycle. As the flow rate condition under which the refrigeration cycle operates is higher, the specific angle becomes larger. That is, when the inclination angle θ2 is large, the effect of the inertia force relatively decreases under the high flow rate condition and the effect of the gravity relatively increases under the low flow rate condition. Thus, the distribution ratio under the high flow rate condition becomes closer to 50% than the distribution ratio under the low flow rate condition. Further, when the inclination angle θ2 is small, the effect of the inertia force relatively increases under the high flow rate condition and the effect of the gravity relatively decreases under the low flow rate condition. Thus, the distribution ratio under the low flow rate condition becomes closer to 50% than the distribution ratio under the high flow rate condition.

Further, when the inclination angle θ2 is less than 50 degrees, although the allowable range of distribution ratio can be achieved under the low flow rate condition, the allowable range of distribution ratio cannot be achieved under the high flow rate condition. When the inclination angle θ2 is more than 90 degrees, although the allowable range of distribution ratio can be achieved under the high flow rate condition, the allowable range of distribution ratio cannot be achieved under the low flow rate condition.

Therefore, to provide the distribution ratio that can achieve the allowable range of heat exchanger performance regardless of whether the refrigeration cycle operates under the low flow rate condition or the high flow rate condition to always maintain high operation efficiency of the refrigeration cycle, the inclination angle θ2 should be 50 degrees or more and 90 degrees or less.

<Usage of Heat Exchanger>

An example of usage of the heat exchanger according to Embodiment 1 will be described below.

Although the heat exchanger according to Embodiment 1 is used in the air-conditioning apparatus in the following description, the present invention is not limited thereto, and for example, the heat exchanger may be used in other refrigeration cycle apparatuses having a refrigerant circuit. Further, although the air-conditioning apparatus switches a cooling operation and a heating operation in the following description, the present invention is not limited thereto, and the air-conditioning apparatus may perform only a cooling operation or a heating operation.

Figure 7:
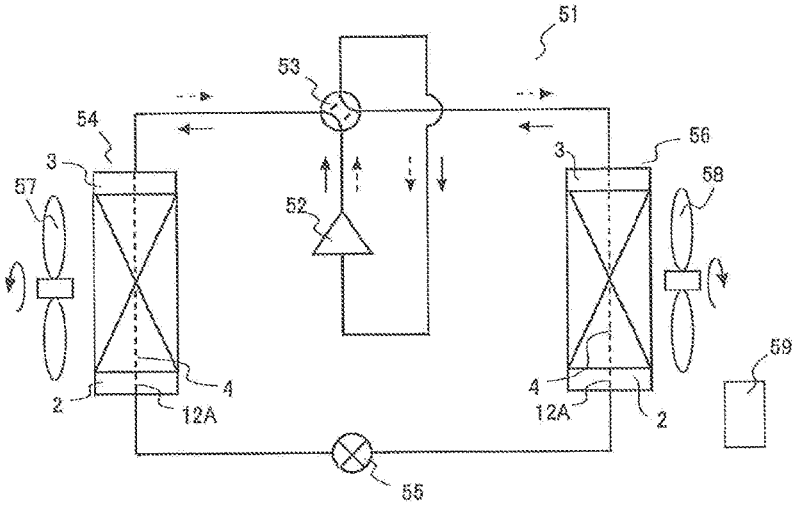
FIG. 7 is a block diagram of an air-conditioning apparatus using the heat exchanger according to Embodiment 1.

FIG. 7 is a block diagram of an air-conditioning apparatus using the heat exchanger according to Embodiment 1. In FIG. 7, the solid arrow represents the flow of refrigerant during cooling operation, while the dotted arrow represents the flow of refrigerant during heating operation.

As shown in FIG. 7, the air-conditioning apparatus 51 includes a compressor 52, a four-way valve 53, an outdoor heat exchanger (heat source side heat exchanger) 54, an expansion device 55, an indoor heat exchanger (load side heat exchanger) 56, an outdoor fan (heat source side fan) 57, an indoor fan (load side fan) 58, and a controller 59. The compressor 52, the four-way valve 53, the outdoor heat exchanger 54, the expansion device 55, and the indoor heat exchanger 56 are connected by the refrigerant pipe so that the refrigerant circuit is formed.

The controller 59 is connected to, for example, the compressor 52, the four-way valve 53, the expansion device 55, the outdoor fan 57, the indoor fan 58, and various sensors. The controller 59 switches the flow paths of the four-way valve 53, thereby switching the cooling operation and the heating operation.

The flow of refrigerant during cooling operation will be described.

The refrigerant discharged from the compressor 52 in a high pressure and high temperature gas state flows into the outdoor heat exchanger 54 via the four-way valve 53, and is condensed by exchanging heat with air supplied by the outdoor fan 57. The condensed refrigerant becomes a high pressure liquid state, flows out of the outdoor heat exchanger 54, and becomes a low pressure gas-liquid two-phase state by the expansion device 55. The refrigerant in the low pressure gas-liquid two-phase state flows into the indoor heat exchanger 56, and evaporates by exchanging heat with air supplied by the indoor fan 58 to cool the indoor space. The evaporated refrigerant becomes a low pressure gas state, flows out of the indoor heat exchanger 56, and is suctioned into the compressor 52 via the four-way valve 53.

The flow of refrigerant during heating operation will be described.

The refrigerant discharged from the compressor 52 in a high pressure and high temperature gas state flows into the indoor heat exchanger 56 via the four-way valve 53, and is condensed by exchanging heat with air supplied by the indoor fan 58 to heat the indoor space. The condensed refrigerant becomes a high pressure liquid state, flows out of the indoor heat exchanger 56, and becomes a low pressure gas-liquid two-phase state by the expansion device 55. The refrigerant in the low pressure gas-liquid two-phase state flows into the outdoor heat exchanger 54, and evaporates by exchanging heat with air supplied by the outdoor fan 57. The evaporated refrigerant becomes a low pressure gas state, flows out of the outdoor heat exchanger 54, and is suctioned into the compressor 52 via the four-way valve 53.

The heat exchanger 1 is used for at least one of the outdoor heat exchanger 54 and the indoor heat exchanger 56. When the heat exchanger 1 operates as an evaporator, the heat exchanger 1 is connected so that refrigerant flows through the stacking type header 2 and into the header 3. That is, when the heat exchanger 1 operates as an evaporator, refrigerant in the gas-liquid two-phase state flows through the refrigerant pipe into the stacking type header 2. Further, when the heat exchanger 1 operates as a condenser, refrigerant flows in the opposite direction in the stacking type header 2.

<Effect of Heat Exchanger>

The effect of the heat exchanger according to Embodiment 1 will be described below.

In the branch flow path 12*b*_2, the first outflow flow path 33 and the second outflow flow path 34 allow refrigerant to linearly flow out in the upwardly and downwardly inclined directions D1 and D2, respectively, which are directions defined by inclining a line having a start point located at the center of the branch section 31 and an end point located at the same level as the center in the gravity direction so that the end point is brought toward the plane P2. Thus, compared with the case where the first outflow flow path 33 and the second outflow flow path 34 allow refrigerant to linearly flow out in the direction having a start point located at the center of the branch section 31 and an end point located at the same level as the center in the gravity direction, the effect of inertia force generated when refrigerant passes through the inflow flow path 32 can be reduced, thereby improving uniformity of distribution of refrigerant that flows out of the plurality of first outlet flow paths 11A of the stacking type header 2.

Further, in the branch flow path 12*b*_2, refrigerant flowing into the branch section 31 is branched into the first outflow flow path 33 and the second outflow flow path 34, that is, two outflow flow paths in the opposite directions D1 and D2. As a result, error factor can be reduced, thereby further improving uniformity of distribution of refrigerant that flows out of the plurality of first outlet flow paths 11A of the stacking type header 2. In particular, when the partial flow path 23*y*1 allows the branch section 31 to communicate with the upper end 23Ya located on the upper side in the gravity direction and the partial flow path 23*y*2 allows the branch section 31 to communicate with the lower end 23Yb located on the lower side in the gravity direction, uniformity of distribution of refrigerant that flows out of the plurality of first outlet flow paths 11A decrease due to the effect of the gravity. Thus, the effectiveness of allowing refrigerant to flow out in the upwardly and downwardly inclined directions D1 and D2 is improved.

Further, since the branch flow path 12*b*_2 is formed by closing an area other than an area of the flow path 23A formed in the third plate shaped member 23 where refrigerant flows into and flows out by using the adjacent stacked members, the distribution flow path 12A having improved uniformity of refrigerant distribution can be achieved without complicated configuration, thereby reducing the cost of components, manufacturing processes and the like.

Further, when the first heat-transfer tube 4 is a flat tube or when the first heat-transfer tube 4 is a circular tube having a small diameter, the cross sectional area of the flow path is significantly small, causing the pressure loss to increase and the operation efficiency of the refrigeration cycle to decrease compared with the case where the first heat-transfer tube 4 is the conventional circular tube that does not have a small diameter. As a consequence, the number of paths of the heat exchanger 1 (that is, the number of first heat-transfer tubes 4) needs to be increased to prevent decrease in the operational efficiency. In the conventional stacking type header, it is necessary to increase in size in the circumferential direction, which is perpendicular to the refrigerant flow direction, to increase the number of paths. In the stacking type header 2, however, increase in size in the circumferential direction, which is perpendicular to the refrigerant flow direction, can be prevented because the number of plate shaped members can be increased. That is, even if the first heat-transfer tube 4 is a flat tube or when the first heat-transfer tube 4 is a circular tube having a small diameter, both the downsizing and the uniformity of refrigerant distribution can be improved.

<Variation-1>

Figure 8:
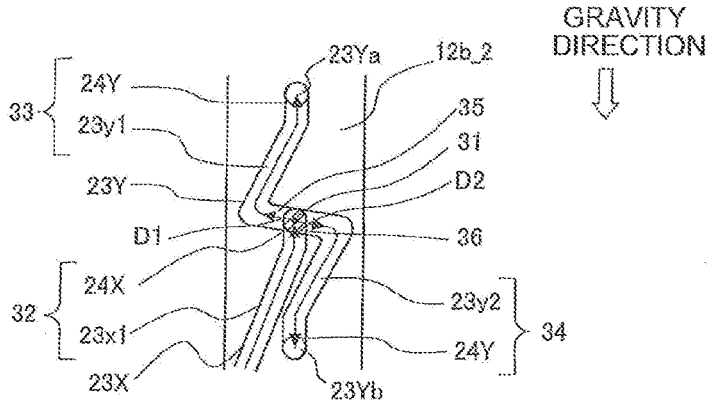
FIG. 8 is a view of overlapped front views of the respective flow paths of the branch flow path of Variation-1 of the heat exchanger according to Embodiment 1.

FIG. 8 is a view of overlapped front views of the respective flow paths of the branch flow path of Variation-1 of the heat exchanger according to Embodiment 1.

As shown in FIG. 8, the end of the partial flow path 23*x*1 communicating with the flow path 24X may be formed parallel to the gravity direction. That is, a part of the partial flow path 23*x*1 may be formed not to be parallel to the gravity direction. In this configuration, it is also effective to allow refrigerant to flow in the upwardly and downwardly inclined directions D1 and D2, because decrease in uniformity of refrigerant distribution due to the inertia force generated when refrigerant passes through the partial flow path 23*x*1 can be prevented.

<Variation-2>

Figure 9:
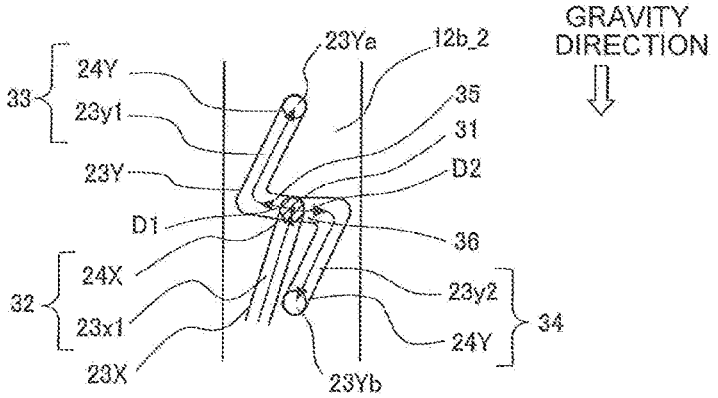
FIG. 9 is a view of overlapped front views of the respective flow paths of the branch flow path of Variation-2 of the heat exchanger according to Embodiment 1.

FIG. 9 is a view of overlapped front views of the respective flow paths of the branch flow path of Variation-2 of the heat exchanger according to Embodiment 1.

As shown in FIG. 9, only one of the first outflow flow path 33 and the second outflow flow path 34 may allow refrigerant to flow out in the upwardly or downwardly inclined direction defined by inclining a line having a start point located at the center of the branch section 31 and an end point located at the same level as the center in the gravity direction so that the end point is brought toward the plane P2. Alternatively, the direction D1 and the direction the direction D2 may be inclined upwardly or downwardly by different angles. Although uniformity of refrigerant distribution decreases compared with the case where the refrigerant flowing into the branch section 31 is branched into the first outflow flow path 33 and the second outflow flow path 34 extending in the opposite directions D1 and D2, respectively, the configuration is still effective in that the effect of the inertia force generated when refrigerant passes through the partial flow path 23*x*1 can be reduced.

<Variation-3>

Figure 10:
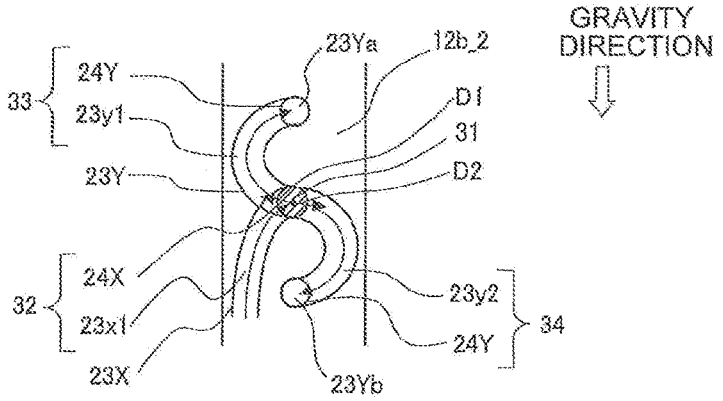
FIG. 10 is a view of overlapped front views of the respective flow paths of the branch flow path of Variation-3 of the heat exchanger according to Embodiment 1.

FIG. 10 is a view of overlapped front views of the respective flow paths of the branch flow path of Variation-3 of the heat exchanger according to Embodiment 1.

As shown in FIG. 10, each of the partial flow path 23*y*1 and the partial flow path 23*y*2 may not include the linear sections 35 and 36 that communicate with the branch section 31 in a linear shape. Although uniformity of refrigerant distribution decreases compared with the case where the refrigerant flowing into the branch section 31 is branched into the first outflow flow path 33 and the second outflow flow path 34 that include the linear sections 35 and 36, respectively, the configuration is still effective in that the effect of the inertia force generated when refrigerant passes through the partial flow path 23*x*1 can be reduced.

<Variation-4>

Figure 11:
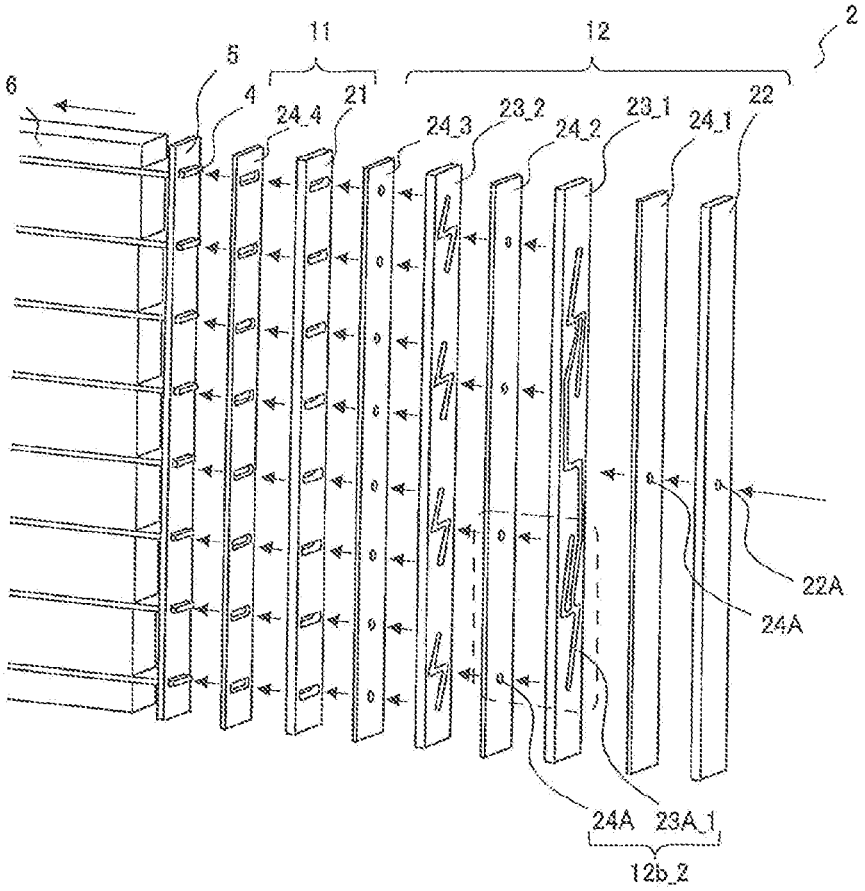
FIG. 11 is a perspective view of Variation-4 of the heat exchanger according to Embodiment 1 showing a stacking type header in an exploded state.
Figure 12:
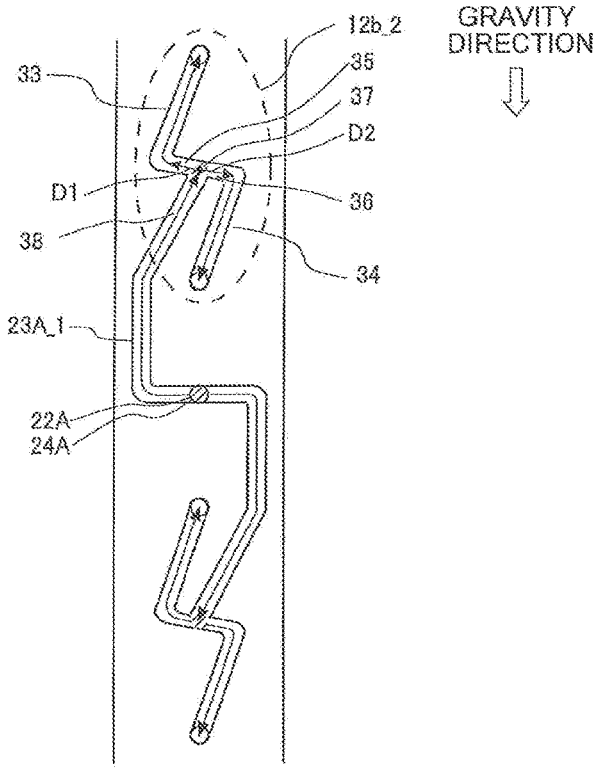
FIG. 12 is a view of overlapped front views of the respective flow paths of the branch flow path and a flow path communicating with these flow paths in Variation-4 of the heat exchanger according to Embodiment 1.

FIG. 11 is a perspective view of Variation-4 of the heat exchanger according to Embodiment 1 showing a stacking type header in an exploded state. FIG. 12 is a view of overlapped front views of the respective flow paths of the branch flow path and the flow path communicating with these flow paths in Variation-4 of the heat exchanger according to Embodiment 1.

As shown in FIGS. 11 and 12, refrigerant branched when flowing into the flow path 23A may be further branched at a sub-branch section 37 formed in the flow path 23A. That is, the branch flow path 12*b*_2 may be formed to branch the refrigerant flowing from the partial flow path 38, which is a part of the flow path 23A, not the refrigerant flowing from the flow path 24X. With this configuration, the number of plate shaped members is decreased, thereby reducing the cost of components, manufacturing processes and the like. The sub-branch section 37 may also be formed in the third plate shaped member 23 other than the third plate shaped member 23_1. Further, the refrigerant branched by the sub-branch section 37 of the flow path 23A may be further branched by another sub-branch section formed in the flow path 23A. The sub-branch section 37 corresponds to the "branch section" in the present invention. The partial flow path 38 corresponds to the "inflow flow path" in the present invention.

Embodiment 2

A heat exchanger according to Embodiment 2 will be described.

The description duplicated or similar to that of Embodiment 1 is simplified or omitted as appropriate.

<Configuration of Heat Exchanger>

A configuration of the heat exchanger according to Embodiment 2 will be described below.

Figure 13:
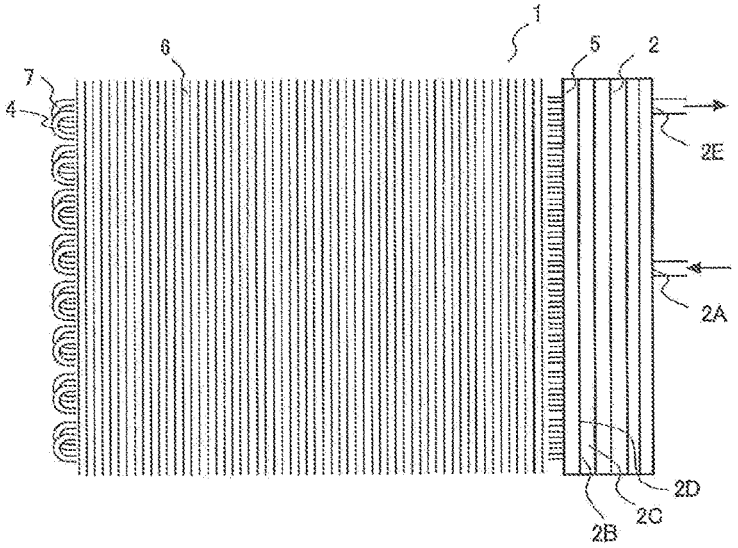
FIG. 13 is a view showing a configuration of the heat exchanger according to Embodiment 2.

FIG. 13 is a view showing the configuration of the heat exchanger according to Embodiment 2.

As shown in FIG. 13, the heat exchanger 1 includes the stacking type header 2, the plurality of first heat-transfer tubes 4, a plurality of second heat-transfer tubes 7, the holding member 5, and the plurality of fins 6.

The stacking type header 2 includes the refrigerant inlet 2A, the plurality of refrigerant outlets 2B, a plurality of refrigerant turning back sections 2C, a plurality of refrigerant inlets 2D and a refrigerant outlet 2E. The refrigerant outlet 2E is connected to the refrigerant pipe. The first heat-transfer tube 4 and the second heat-transfer tube 7 are flat tubes that are bent in hairpin shape. The refrigerant outlet 2B and the refrigerant turning back section 2C are connected by the first heat-transfer tube 4, and the refrigerant turning back section 2C and the refrigerant inlet 2D are connected by the second heat-transfer tube 7.

<Flow of Refrigerant in Heat Exchanger>

The flow of refrigerant in the heat exchanger according to Embodiment 2 will be described below.

After flowing in the plurality of first heat-transfer tubes 4, refrigerant flows into the plurality of refrigerant turning back sections 2C of the stacking type header 2 for turning back, and flows into the plurality of second heat-transfer tubes 7. Refrigerant in the plurality of second heat-transfer tubes 7 exchanges heat with, for example, air supplied by a fan. After flowing in the plurality of second heat-transfer tubes 7, refrigerant flows into the stacking type header 2 for merging via the plurality of refrigerant inlets 2D, and flows into the refrigerant pipe via the refrigerant outlet 2E. Refrigerant can flow in the reverse direction.

<Configuration of Stacking Type Header>

A configuration of the stacking type header of the heat exchanger according to Embodiment 2 will be described below.

Figure 14:
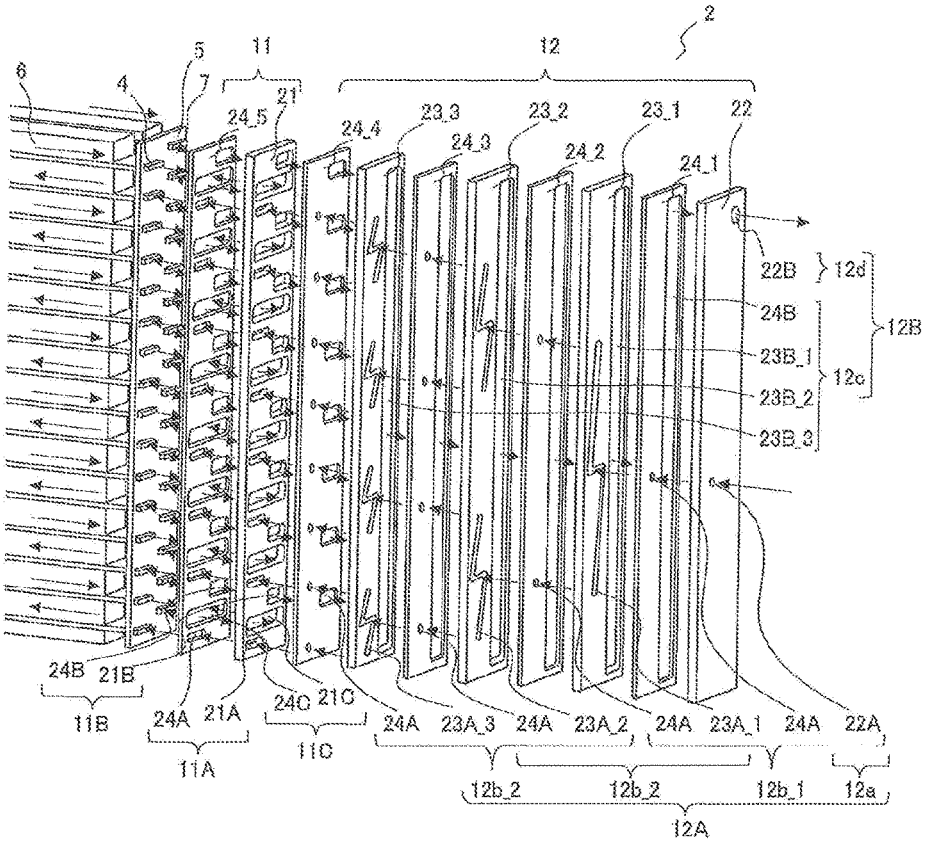
FIG. 14 is a perspective view of the heat exchanger according to Embodiment 2 showing the stacking type header in an exploded state.

FIG. 14 is a perspective view of the heat exchanger according to Embodiment 2 showing the stacking type header in an exploded state.

As shown in FIG. 14, a plurality of second inlet flow paths 11B are made up of flow paths 21B formed in the first plate shaped member 21 and flow paths 24B formed in the clad material 24_5. The flow path 21B and the flow path 24B are through holes having an inner peripheral surface extending along an outer peripheral surface of the second heat-transfer tube 7. The plurality of second inlet flow paths 11B correspond to the plurality of refrigerant inlets 2D in FIG. 13.

A plurality of turning back flow paths 11C are made up of flow paths 21C formed in the first plate shaped member 21 and flow paths 24C formed in the clad material 24_5. The flow path 21C and the flow path 24C are through holes having an inner peripheral surface surrounding an outer peripheral surface of an end of the first heat-transfer tube 4 through which refrigerant flows out and an outer peripheral surface of an end of the second heat-transfer tube 7 through which refrigerant flows in. The plurality of turning back flow paths 11C corresponds to the plurality of refrigerant turning back sections 2C in FIG. 13.

A merging flow path 12B is made up of flow paths 22B formed in the second plate shaped member 22, flow paths 23B_1 to 23B_3 formed in the third plate shaped members 23_1 to 23_3, and flow paths 24B formed in the clad materials 24_1 to 24_4. The merging flow path 12B includes a mixing flow path 12*c* and a second outlet flow path 12*d*.

The second outlet flow path 12*d* is made up of the flow path 22B formed in the second plate shaped member 22. The flow path 22B is a circular through hole. The refrigerant pipe is connected to the second outlet flow path 12*d*. The second outlet flow path 12*d* corresponds to the refrigerant outlet 2E in FIG. 13.

The mixing flow path 12*c* is made up of the flow paths 23B_1 to 23B_3 formed in the third plate shaped members 23_1 to 23_3, and the flow paths 24B formed in the clad materials 24_1 to 24_4. The flow paths 23B_1 to 23B_3 and the flow paths 24B are rectangular shaped through holes that penetrate almost the entire area of the plate shaped members in the height direction.

Further, a plurality of merging flow paths 12B may be formed in the second plate shaped body 12 so that the respective merging flow paths 12B may be connected to parts of the plurality of second inlet flow paths 11B formed in the first plate shaped body 11. Alternatively, the second outlet flow path 12*d* may be formed in the plate shaped member other than the second plate shaped member 22.

<Flow of Refrigerant in Stacking Type Header>

The flow of refrigerant in the stacking type header of the heat exchanger according to Embodiment 2 will be described below.

After flowing in the plurality of first heat-transfer tubes 4, refrigerant flows into the plurality of turning back flow paths 11C, and is turned back into the plurality of second heat-transfer tubes 7. After flowing in the plurality of second heat-transfer tubes 7, refrigerant passes through the plurality of second inlet flow paths 11B and flows into the mixing flow path 12*c* for mixing. The mixed refrigerant flows through the second outlet flow path 12*d* and into the refrigerant pipe.

<Usage of Heat Exchanger>

An example of usage of the heat exchanger according to Embodiment 2 will be described below.

Figure 15:
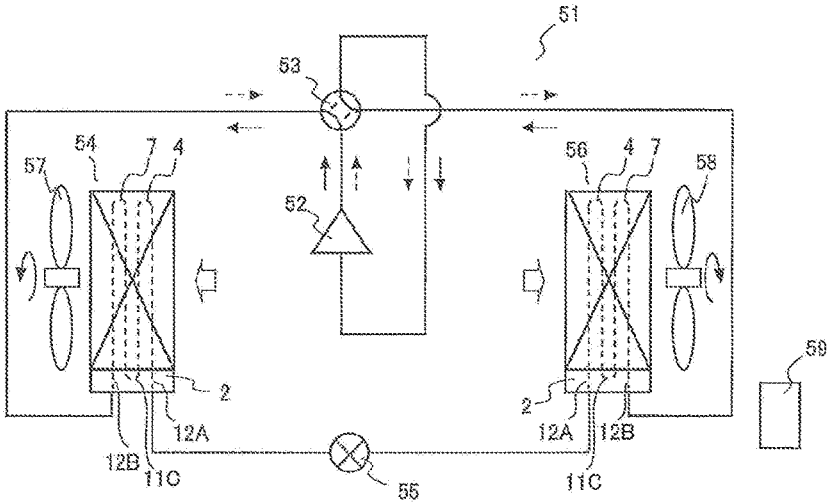
FIG. 15 is a block diagram of the air-conditioning apparatus using the heat exchanger according to Embodiment 2.

FIG. 15 is a block diagram of an air-conditioning apparatus using the heat exchanger according to Embodiment 2.

As shown in FIG. 15, the heat exchanger 1 is used for at least one of the outdoor heat exchanger 54 and the indoor heat exchanger 56. When the heat exchanger 1 operates as an evaporator, the heat exchanger 1 is connected so that refrigerant flows through the distribution flow path 12A of the stacking type header 2 and flows into the first heat-transfer tube 4, and flows in the second heat-transfer tube 7, and then flows in the merging flow path 12B of the stacking type header 2. That is, when the heat exchanger 1 operates as an evaporator, refrigerant in the gas-liquid two-phase state flows through the refrigerant pipe into the distribution flow path 12A in the stacking type header 2. Further, when the heat exchanger 1 operates as a condenser, refrigerant flows in the opposite direction in the stacking type header 2.

<Effect of Heat Exchanger>

The effect of the heat exchanger according to Embodiment 2 will be described below.

The plurality of second inlet flow paths 11B are formed in the first plate shaped body 11, and the merging flow path 12B is formed in the second plate shaped body 12. Thus, the header 3 is not necessary, thereby reducing the cost of components and the like of the heat exchanger 1. Further, since the header 3 is not necessary, it is possible to extend the first heat-transfer tube 4 and the second heat-transfer tube 7 and decrease the number of fins 6, increasing a mounting volume of the heat exchanging section of the heat exchanger 1.

Further, the turning back flow path 11C is formed in the first plate shaped body 11. Thus, the amount of heat exchange can be increased, for example, without changing an area in front view of the heat exchanger 1.

While Embodiment 1 and Embodiment 2 are described above, the present invention is not limited to the description of these Embodiments. For example, combination of all or parts of these Embodiments can be used in the present invention.

REFERENCE SIGNS LIST

1 heat exchanger 2 stacking type header 2A refrigerant inlet 2B refrigerant outlet 2C refrigerant turning back section 2D refrigerant inlet 2E refrigerant outlet 3 header 3A refrigerant inlet 3B refrigerant outlet 4 first heat-transfer tube 5 holding member 6 fin 7 second heat-transfer tube 11 first plate shaped body 11A first outlet flow path 11B second inlet flow path 11C turning back flow path 12 second plate shaped body 12A distribution flow path 12B merging flow path 12*a* first inlet flow path 12*b*, 12*b*_1, 12*b*_2 branch flow path 12*c* mixing flow path 12*d* second outlet flow path 21 first plate shaped member 21A to 21C flow path 22 second plate shaped member 22A, 22B flow path 23, 23_1 to 23_3 third plate shaped member 23A, 23A_1 to 23A_3, 23B_1 to 23B_3, 23X, 23Y flow path 23*x*1, 23*y*1, 23*y*2 partial flow path 23Ya upper end 23Yb lower end 24, 24_1 to 24_5 clad material 24A to 24C, 24X, 24Y flow path 31 branch section 32 inflow flow path 33 first outflow flow path 34 second outflow flow path 35, 36 linear section 37 sub-branch section 38 partial flow path 51 air-conditioning apparatus 52 compressor 53 four-way valve 54 outdoor heat exchanger 55 expansion device 56 indoor heat exchanger 57 outdoor fan 58 indoor fan 59 controller

The invention claimed is:

1. A stacking type header comprising:

a first plate shaped body having a plurality of first outlet flow paths; and a second plate shaped body attached to the first plate shaped body and having a first inlet flow path, the second plate shaped body having at least a part of a distribution flow path to allow refrigerant flowing from the first inlet flow path to be distributed and flow out to the plurality of first outlet flow paths, wherein the distribution flow path includes at least one branch flow path having an inflow flow path, a branch section communicating with the inflow flow path, and two outflow flow paths communicating with the branch section, each outflow path includes a linear section, which linearly joins with the branch section, and a curved section, which is formed downstream of the linear section, the inflow flow path includes a partial flow path, which is non-parallel and non-perpendicular to a gravity direction to allow the refrigerant to flow into the branch section via the partial flow path, at least a first outflow flow path of the two outflow flow paths allows the refrigerant to flow out in a direction that is upwardly or downwardly inclined from a direction extending through the center of the branch section and perpendicular to the partial flow path at an end of the first outflow flow path that is joined with the branch section.

2. The stacking type header of claim 1, wherein the two outflow flow paths are inclined oppositely to one another, so that the first outflow flow path is upwardly inclined, and a second outflow flow path of the two outflow flow paths is downwardly inclined.

3. The stacking type header of claim 1, wherein, an end of the first outflow flow path that does not join with the branch section is located at a position higher in the gravity direction than the end of the first outflow flow path that is joined with the branch section, and an end of a second outflow flow path of the two outflow flow paths that does not join with the branch section is located at a position lower in the gravity direction than an end of the second outflow flow path that joins with the branch section.

4. The stacking type header of claim 1, wherein each of the two outflow flow paths is formed to allow the refrigerant to flow in a direction inclined upwardly or downwardly by 40 degrees or less from a direction extending through the center of the branch section and perpendicular to the gravity direction.

5. The stacking type header of claim 1, wherein each of the two outflow flow paths is formed to allow the refrigerant to flow in a direction that is parallel to the partial flow path and is inclined to a straight line extending through the center of the branch section by an angle of 50 degrees or more and 90 degrees or less at the curved section.

6. The stacking type header of claim 1, wherein the second plate shaped body includes at least one plate shaped member having a recess, and the at least one branch flow path is formed by closing an area of the recess other than an area into which the refrigerant flows and an area from which the refrigerant flows out.

7. The stacking type header of claim 1, wherein the refrigerant branched flows into the inflow flow path, or the refrigerant flowing out of the at least one outflow flow path is branched.

8. A heat exchanger comprising:

the stacking type header of claim 1; and a plurality of heat-transfer tubes connected to each of the plurality of first outlet flow paths.

9. The heat exchanger of claim 8, wherein each of the plurality of heat-transfer tubes is a flat tube.

10. The heat exchanger of claim 8, wherein each of the plurality of heat-transfer tubes is a circular tube.

11. An air-conditioning apparatus comprising the heat exchanger of claim 8, wherein the heat exchanger comprises an evaporator, and the distribution flow path allows the refrigerant to flow into the plurality of first outlet flow paths.

* * * * *